US006971649B2

(12) United States Patent
Richardson et al.

(10) Patent No.: US 6,971,649 B2
(45) Date of Patent: Dec. 6, 2005

(54) ZERO-SUM TILING GAME

(76) Inventors: Jeff Richardson, 9826 N. Camino Vado, Tucson, AZ (US) 85737; Jon A. Petty, 9960 N. Hacienda Hermosa, Oro Valley, AZ (US) 85737; E. Tal Ehlers, 16601 W. Whitewing Way, Avra Valley, AZ (US) 85653

( * ) Notice: Subject to any disclaimer, the term of this patent is extended or adjusted under 35 U.S.C. 154(b) by 447 days.

(21) Appl. No.: 10/093,994

(22) Filed: Mar. 6, 2002

(65) Prior Publication Data

US 2003/0168809 A1 Sep. 11, 2003

(51) Int. Cl.[7] ..... A63F 1/00

(52) U.S. Cl. ..... 273/299; 273/309; 273/293; 273/294; 273/295; 273/296

(58) Field of Search ..... 273/299, 296, 273/292, 295, 293, 303, 304

(56) References Cited

U.S. PATENT DOCUMENTS

| | | | | | |
|---|---|---|---|---|---|
| 133,697 | A | * | 12/1872 | Chinnock | 144/358 |
| 943,058 | A | * | 12/1909 | Ashenden | 273/299 |
| 977,117 | A | * | 11/1910 | McPherson | 273/299 |
| 1,246,152 | A | * | 11/1917 | Perrine | 434/209 |
| 1,320,628 | A | * | 11/1919 | Lowman | 273/299 |
| 1,332,249 | A | * | 3/1920 | Feero | 273/299 |
| 1,377,327 | A | * | 5/1921 | Ebert | 273/299 |
| 1,485,146 | A | * | 2/1924 | Mundell | 273/296 |
| 1,528,061 | A | * | 3/1925 | Joyce | 273/296 |
| 1,551,680 | A | * | 9/1925 | Meissner | 273/299 |
| 1,556,344 | A | * | 10/1925 | Phimister | 273/299 |
| 1,584,062 | A | * | 5/1926 | Williamson | 273/292 |
| 2,198,670 | A | * | 4/1940 | Johnson | 273/299 |
| 2,253,823 | A | * | 8/1941 | Suteras | 273/293 |
| 2,748,500 | A | * | 6/1956 | Cormack | 434/205 |
| 3,330,053 | A | | 7/1967 | Hendrix | |
| 3,482,333 | A | * | 12/1969 | Trager, Jr. | 273/299 |
| D222,490 | S | * | 10/1971 | Alaska | D34/13 |
| 3,680,866 | A | * | 8/1972 | Kerr | 273/293 |
| 3,692,310 | A | | 9/1972 | Martin | |
| 3,785,655 | A | * | 1/1974 | Babb | 273/292 |
| 3,804,415 | A | | 4/1974 | Ryan | |
| 3,827,695 | A | | 8/1974 | Hess | |
| 4,111,428 | A | * | 9/1978 | Barbosa | 273/262 |
| 4,125,263 | A | * | 11/1978 | Hamilton | 273/293 |

(Continued)

FOREIGN PATENT DOCUMENTS

GB 2 191 953 A * 12/1987 ..... A63F 9/20

*Primary Examiner*—Gregory Vidovich
*Assistant Examiner*—Dolores R. Collins
(74) *Attorney, Agent, or Firm*—Quarles & Brady Streich Lang LLP

(57) ABSTRACT

A zero-sum tiling game. A plurality of "domino-like" game pieces include indicia viewable on the top surfaces of the game pieces that correspond to one, or the other, or both of two halves of the game pieces. The indicia forms a binary set. The indicia associated with one half of the game piece may be summed to indicate the value for that type of indicia for that one half of the game piece, while the indicia may more generally be "added" or "summed" overall to obtain an overall value for any desired number of halves. Particularly, it is an object of the game to lay down game pieces in such a way that each piece that is laid down completes a square that consists of four halves, wherein the sum of the indicia for the four halves is zero.

12 Claims, 8 Drawing Sheets

U.S. PATENT DOCUMENTS

| | | | | | |
|---|---|---|---|---|---|
| 4,236,720 | A | * | 12/1980 | Belony | 273/292 |
| 4,239,231 | A | * | 12/1980 | Henderson | 273/293 |
| 4,281,835 | A | * | 8/1981 | Seiden | 273/299 |
| 4,285,522 | A | * | 8/1981 | Turner | 273/293 |
| 4,317,515 | A | * | 3/1982 | Feeley et al. | 206/315.1 |
| 4,355,812 | A | * | 10/1982 | McCullough | 273/248 |
| 4,359,227 | A | * | 11/1982 | Porciello | 273/268 |
| 4,570,940 | A | * | 2/1986 | Lamle | 273/296 |
| 4,676,510 | A | * | 6/1987 | Agam | 273/292 |
| 4,778,188 | A | | 10/1988 | Brooker | |
| 4,867,455 | A | * | 9/1989 | Fritzman | 273/156 |
| D319,477 | S | | 8/1991 | McElhaney | |
| 5,120,068 | A | * | 6/1992 | Tablan | 273/293 |
| 5,370,398 | A | * | 12/1994 | Nguyen | 273/293 |
| 5,441,278 | A | * | 8/1995 | Nalder | 273/296 |
| 5,478,085 | A | * | 12/1995 | Canner et al. | 273/239 |
| 5,556,102 | A | * | 9/1996 | Huang | 273/299 |
| 5,788,241 | A | * | 8/1998 | Ung | 273/292 |
| 5,904,353 | A | | 5/1999 | Aldridge | |
| 6,022,026 | A | * | 2/2000 | Johnson, III | 273/450 |
| 6,062,566 | A | * | 5/2000 | Lemons | 273/293 |
| 6,422,561 | B1 | * | 7/2002 | Schroeder | 273/272 |
| 6,486,870 | B1 | * | 11/2002 | Kozu | 345/157 |
| 6,517,070 | B1 | * | 2/2003 | Clapera | 273/148 A |

* cited by examiner

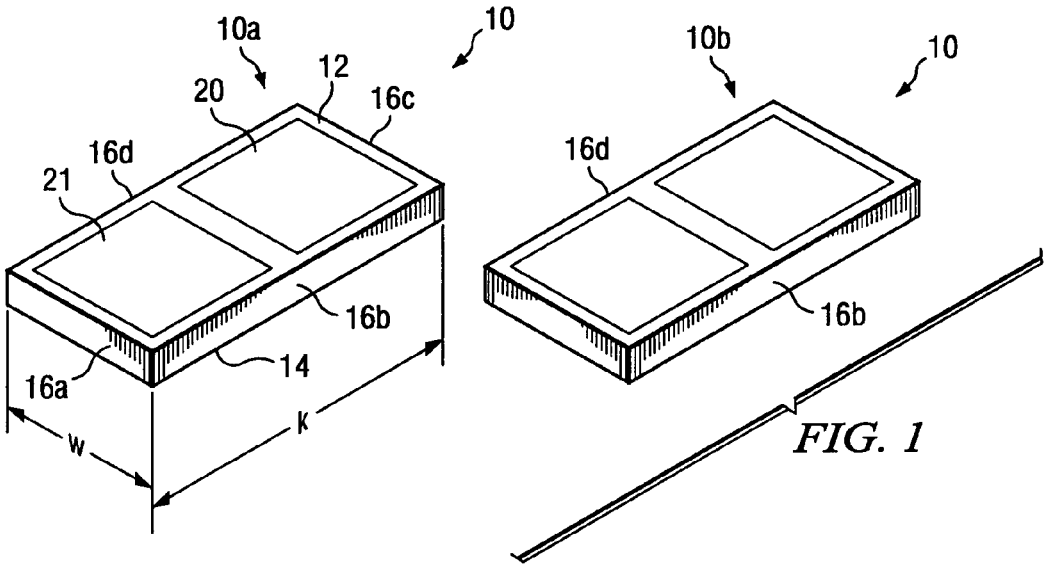
FIG. 1
FIG. 2A1
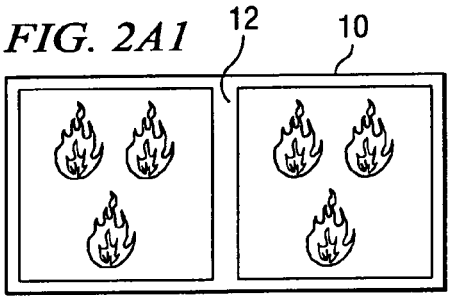
FIG. 2D1
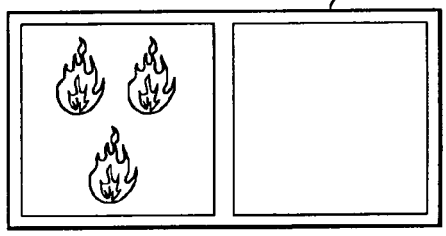
FIG. 2B1
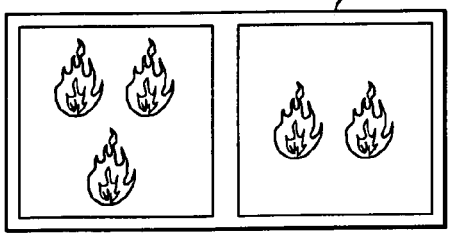
FIG. 2E1
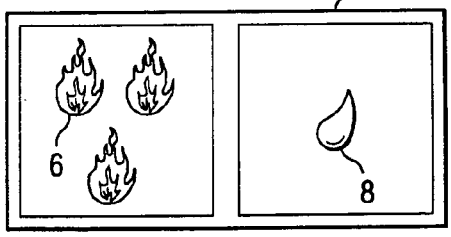
FIG. 2C1
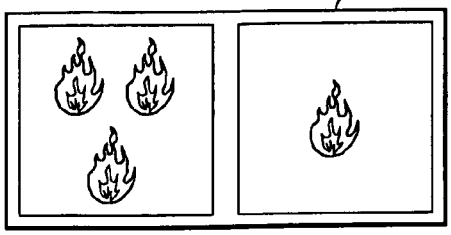
FIG. 2F1
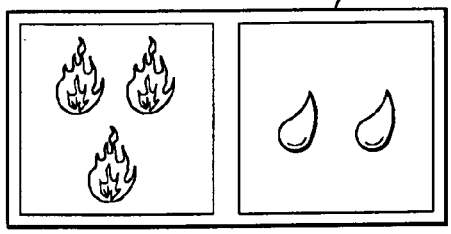

FIG. 2G1
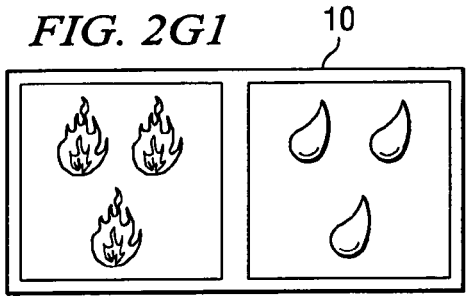
FIG. 2H1
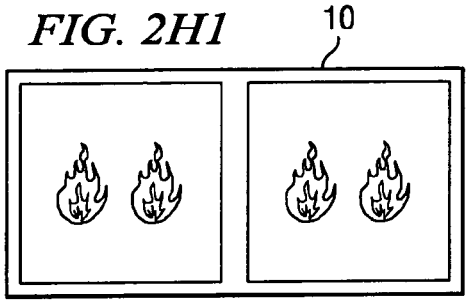
FIG. 2J1
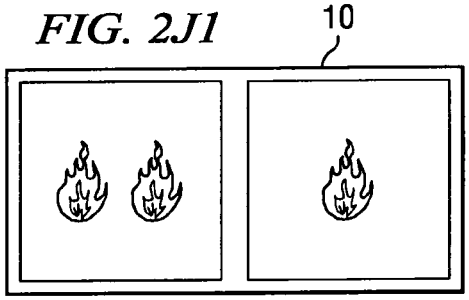
FIG. 2K1
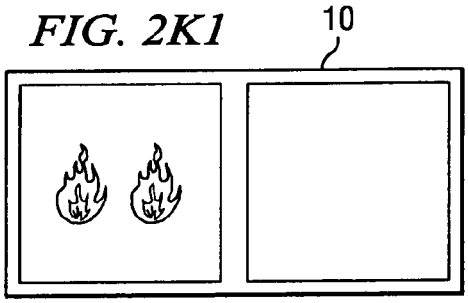
FIG. 2L1
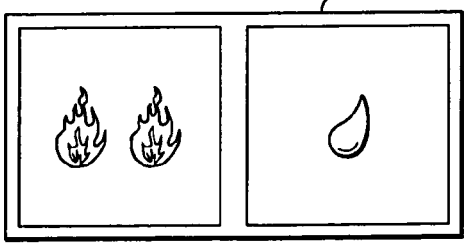
FIG. 2M1
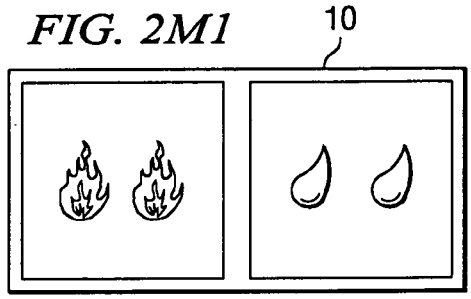
FIG. 2N1
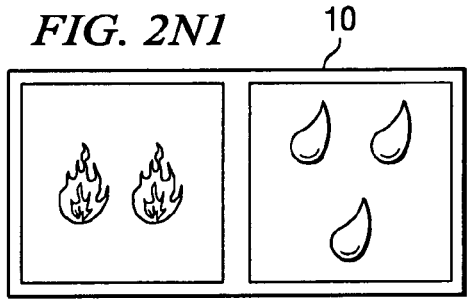
FIG. 2P1
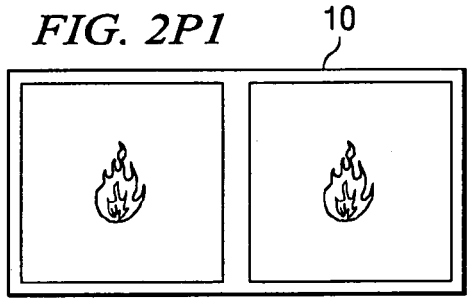
FIG. 2Q1
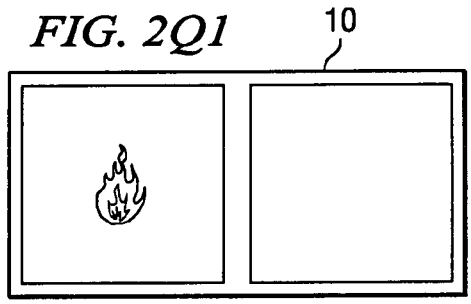
FIG. 2R1
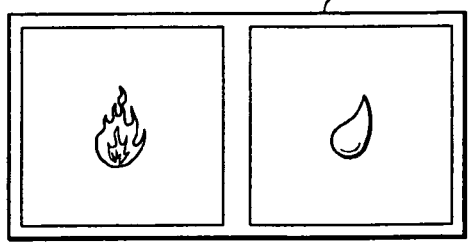

FIG. 2S1
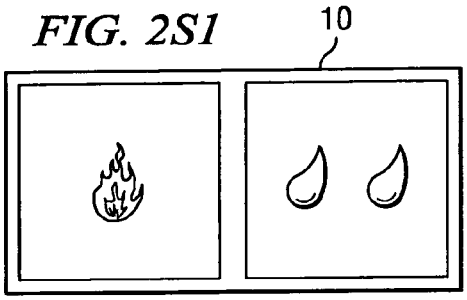
FIG. 2X1
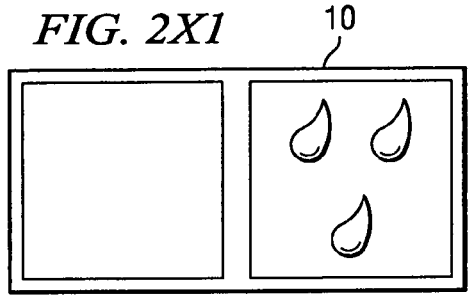
FIG. 2T1
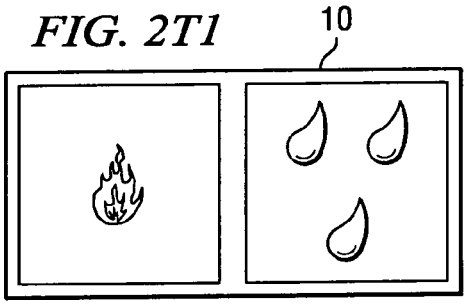
FIG. 2Y1
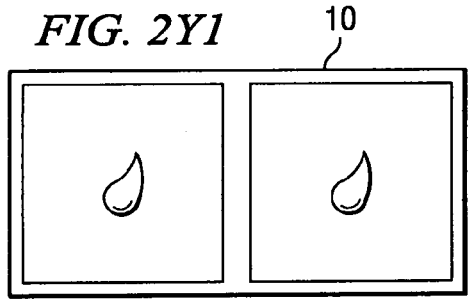
FIG. 2U1
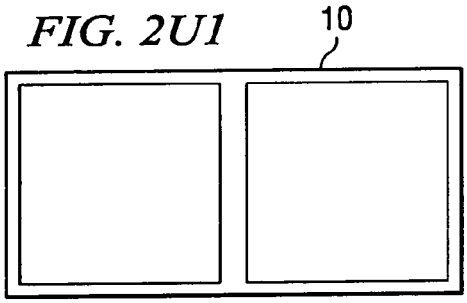
FIG. 2Z1
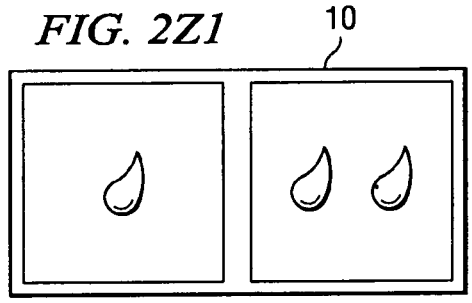
FIG. 2V1
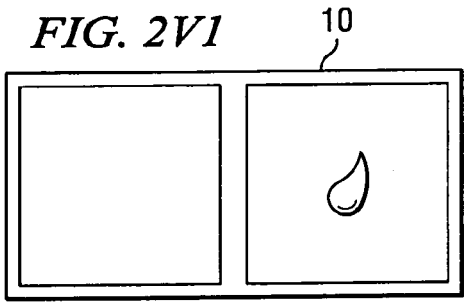
FIG. 2A2
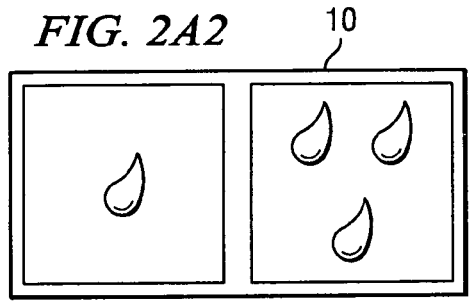
FIG. 2W1
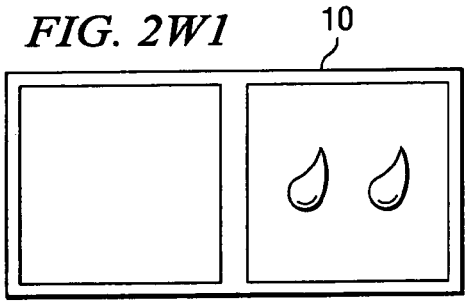
FIG. 2B2
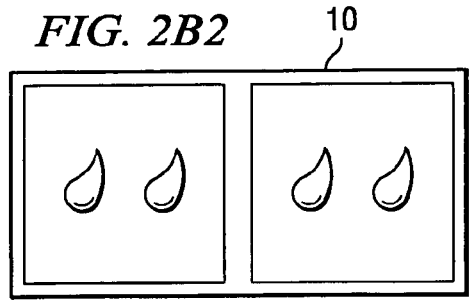

FIG. 2C2
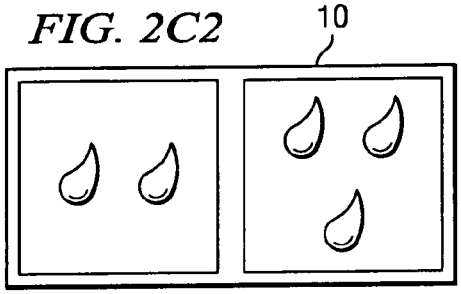
FIG. 2D2
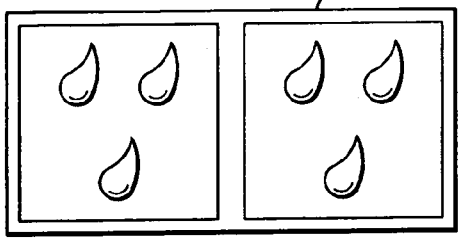
FIG. 4A
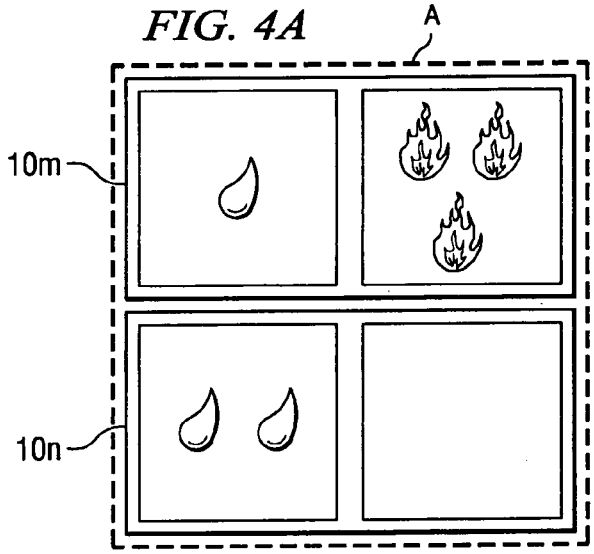
FIG. 4B
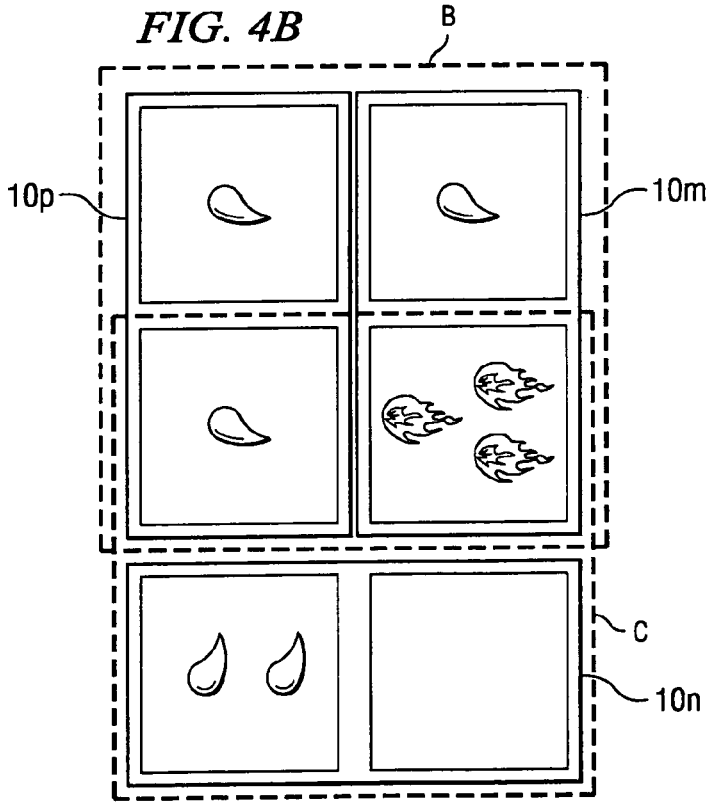

ZERO-SUM TILING GAME

BACKGROUND OF THE INVENTION

The present invention relates to a zero-sum tiling game.

People are always interested in game playing, and there is always room for a new game, especially a game that is easily portable, can be played by two to four players, and is simple to learn and play. Accordingly, there is a need for a zero-sum tiling game providing these benefits.

SUMMARY OF THE INVENTION

The zero-sum tiling game of the present invention meets the aforementioned need by providing a plurality of "domino-like" game pieces having top surfaces and side edges for abutting the game pieces against one another on a playing surface. The game pieces are about twice as long as they are wide in plan, so that the game pieces can be identified as having two substantially equally sized halves and so that the game pieces can be laid down on a playing surface in patterns that tile the playing surface whether both halves of one game piece abut both halves of an adjacent game piece, or whether just one of the halves of the game piece abuts just one of the halves of an adjacent game piece.

At least a sub-set of the game pieces includes indicia viewable on the top surfaces of the game pieces that are positioned so as to correspond to or be associated with one, or the other, or both of the two halves of the game piece. The indicia define a binary set, or one of two polarity types. A first number of the indicia of one polarity type is provided that is associated with one of the halves of a given game piece, and a second number of the other polarity type is provided that is associated with the other of the halves of the given game piece, where the integer is preferably zero, one, two, or three. The indicia associated with one half of the game piece may be summed to indicate the value for that type of indicia for that one half of the game piece, while the indicia may more generally be "added" or "summed" overall to obtain an overall value for any desired number of halves. Particularly, it is an object of the game to lay down game pieces in such a way that each piece that is laid down completes a square that consists of four halves, wherein the sum of the indicia for the four halves is zero. The four halves may be parts of one, two or three additional game pieces that have previously been laid down.

Therefore, it is a principal object of the present invention to provide a novel zero-sum tiling game.

It is a further object of the present invention to provide such a game that is easily portable.

It is still a further object of the present invention to provide such a game that can be played by two to four players.

It is yet a further object of the invention to provide such a game that is simple to learn and play.

The foregoing and other objects, features and advantages of the present invention will be more readily understood upon consideration of the following detailed description of the invention, taken in conjunction with the following drawings.

BRIEF DESCRIPTION OF THE DRAWINGS

FIG. 1 is a pictorial view of two game pieces according to the present invention.

FIG. 2A1 is a plan view of a first game piece according to the invention.

FIG. 2B1 is a plan view of a second game piece according to the invention.

FIG. 2C1 is a plan view of a third game piece according to the invention.

FIG. 2D1 is a plan view of a fourth game piece according to the invention.

FIG. 2E1 is a plan view of a fifth game piece according to the invention.

FIG. 2F1 is a plan view of a sixth game piece according to the invention.

FIG. 2G1 is a plan view of a seventh game piece according to the invention.

FIG. 2H1 is a plan view of an eighth game piece according to the invention.

FIG. 2J1 is a plan view of a ninth game piece according to the invention.

FIG. 2K1 is a plan view of an tenth game piece according to the invention.

FIG. 2L1 is a plan view of a eleventh game piece according to the invention.

FIG. 2M1 is a plan view of a twelfth game piece according to the invention.

FIG. 2N1 is a plan view of a thirteenth game piece according to the invention.

FIG. 2P1 is a plan view of a fourteenth game piece according to the invention.

FIG. 2Q1 is a plan view of a fifteenth game piece according to the invention.

FIG. 2R1 is a plan view of a sixteenth game piece according to the invention.

FIG. 2S1 is a plan view of a seventeenth game piece according to the invention.

FIG. 2T1 is a plan view of an eighteenth game piece according to the invention.

FIG. 2U1 is a plan view of a nineteenth game piece according to the invention.

FIG. 2V1 is a plan view of a twentieth game piece according to the invention.

FIG. 2W1 is a plan view of a twenty-first game piece according to the invention.

FIG. 2X1 is a plan view of a twenty-second game piece according to the invention.

FIG. 2Y1 is a plan view of a twenty-third game piece according to the invention.

FIG. 2Z1 is a plan view of a twenty-fourth game piece according to the invention.

FIG. 2A2 is a plan view of a twenty-fifth game piece according to the invention.

FIG. 2B2 is a plan view of a twenty-sixth game piece according to the invention.

FIG. 2C2 is a plan view of a twenty-seventh game piece according to the invention.

FIG. 2D2 is a plan view of a twenty-eighth game piece according to the invention.

DETAILED DESCRIPTION OF A PREFERRED EMBODIMENT

Figure 3:
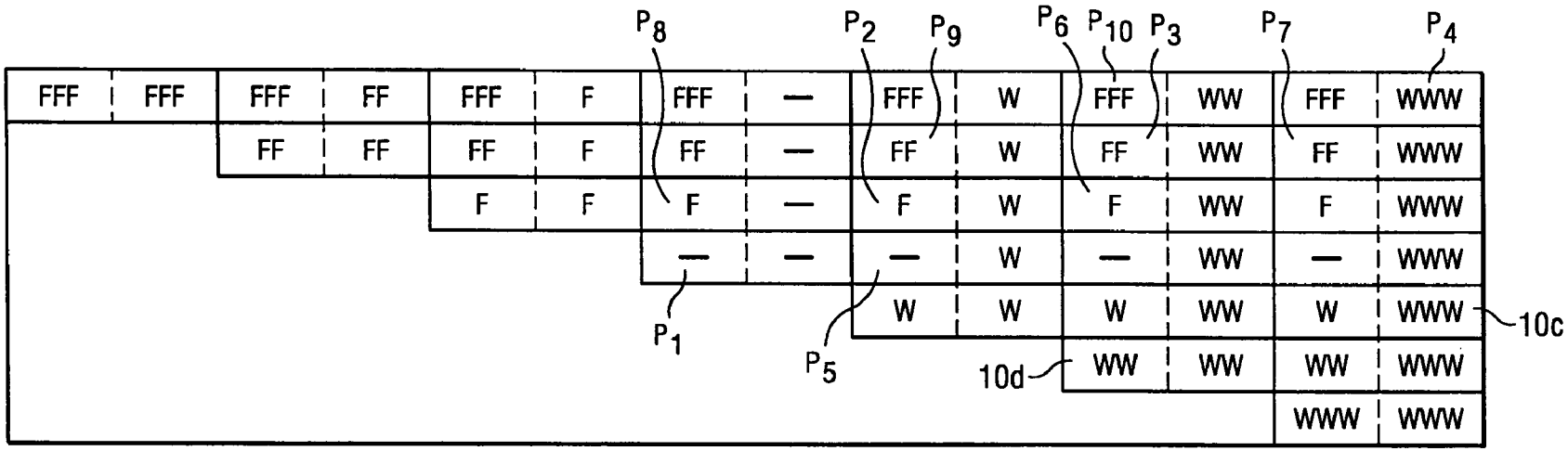
FIG. 3 is a chart showing the distribution of symbols over the twenty-eight game pieces of FIGS. 2A1–2D2.

Referring to FIG. 1, a basic game piece 10 is shown for use in a zero-sum tiling sum game according to the present invention. The game piece 10 has a top surface 12, a bottom surface 14 for laying on a playing surface, and four side surfaces 16*a*–16*d*. The game piece 10 is "domino-like" in that it is rectangular and has a length "k" that is about twice its width "w" in plan. The playing surface is most advantageously provided as a specialized playing board adapted to hold the pieces in place, e.g., by being grooved or by having appropriate projections, but for the utmost in simplicity, portability and cost effectiveness, may be nothing more than a convenient, pre-existing planar surface, such as a table-top or floor. The game pieces and playing surface may also be represented graphically on a video display in a computer programmed version of the game.

For a preferred playing surface having square dimensions of about 10"×10", the game pieces 10 have a width "w" equal to about 1" and a length "k" equal to about 2."

Referring to FIGS. 2A1–2D2, most of the pieces 10 are provided with symbolic indicia. The indicia form a binary set. The indicia may be and are preferably considered to represent opposites, so that they can be mentally associated with "positive" and "negative" or "opposite" values, but this is not essential. Referring particularly to FIG. 2E1, a preferred indicium 6 represents "fire" and a preferred opposite indicium 8 represents "water;" however, other examples of binary sets are "sheep" and "wolf," "boy" and "girl," or, most simply, "+" and "−." Moreover, other mechanisms can be employed to make a binary distinction between indicia, such as by providing the indicia in two different sizes or two different colors. Herein, the indicia in a binary set according to the invention are referred to as being of opposite polarity types.

The indicia are provided on or in, or are displayed on are through, the top surface 12, so they can be viewed when the game piece is turned so that the top surface 12 faces up. According to the invention, the indicia may be added or summed together, including adding the number of indicia of one polarization type to obtain a first total, adding the number of indicia of the other polarization type to obtain a second total, and, since the two polarization types represent opposites, subtracting one total from the other to obtain a total sum. The goal sum may be any predetermined fixed number, but is preferably zero to make the arithmetic easier.

The game pieces may be graphically divided into two halves 20, 21 as shown by the dotted lines in FIG. 1; however, preferably, the two halves 20, 21 are indicated on the top surfaces 12 of the game pieces simply by grouping a first integer number of the indicia of one polarization type in one of the halves and a second integer number of the indicia of the other polarization type in the other of the halves, where the integer is preferably zero, one, two, or three. Accordingly, in the preferred embodiment of the game, each game piece includes a maximum of six indicia and a minimum of zero indicia. FIG. 3 shows the distribution of indicia in FIGS. 2A1–2D2 for a preferred twenty-eight game pieces, wherein "F" indicates "fire," "W" indicates water, and "−" indicates a lack of indicia. The aforementioned integer could be greater than three with suitable addition to the number of game pieces.

The indicia associated with one half of a given game piece 10 may be summed to indicate the value for that type of indicia for that one half of the game piece, while the indicia may more generally be "added" or "summed" overall to obtain an overall value for any desired number of halves. An equal number of positive and negative indicia sums to zero, and the lack of any indicia is also taken as being neutral, i.e., having neither a positive nor a negative value. For example, as can be seen in FIG. 3, there are two game pieces 10*c*, 10*d* having a value +4, i.e., four waters (or fires). The distinction between these two pieces is that, in one of them, three water (or fire) indicia are placed in one half 20 (FIG. 1) of the game piece while one water (or fire) indicium is placed in the other half 21 (FIG. 1), and in the other game piece, two water (or fire) indicia are placed in each half 20 and 21 of the game piece. The overall value of these two game pieces is equal; however, the values for the individual halves of the game pieces differ.

To illustrate how the game pieces may be valued overall, of the twenty-eight game pieces shown in FIG. 3, there are preferably four pieces $P_1$, $P_2$, $P_3$, and $P_4$, having a neutral value of zero, and three pieces $P_5$, $P_6$, and $P_7$, having a value of +1 along with three pieces $P_8$, $P_9$, and $P_{10}$, having a value of −1.

Also as is apparent from FIG. 3, there are no duplicate game pieces, i.e., pieces having the same indicia in both halves. However, duplicate game pieces could be provided and used without detracting from enjoyment of the game, and without departing from the principles of the invention.

An algorithm for determining, generally, how many game pieces are used in the "no duplicates" form of the zero sum tiling game and the value of those game pieces is now provided. The indicia of one type is distributed over some of the game pieces in unique combinations of two sets of integer numbers (j, k) of the indicia, one set corresponding to each "half" of the game piece, as follows: j ranges between zero and a predetermined maximum number N inclusively, and, for each value of j, k ranges from j to N. The indicia of the other type is distributed over other of the game pieces following the same algorithm, except that the duplicate game piece corresponding to (j=0, k=0) is omitted. Finally, both indicia are distributed over the remaining game pieces to form unique combinations (j, k), where j corresponds to one of the indicia and k corresponds to the other, wherein j ranges between 1 and the predetermined maximum number, and k ranges between 1 and the maximum number.

Accordingly, where the predetermined maximum number N is 3, there are 9 game pieces having one just one type of indicia, 9 game pieces having just the other type of indicia, 9 game pieces having both types of indicia, and 1 game piece having no indicia (j=0, k=0), for the total of twenty-eight game pieces. Where N=2, there are 5, 5, 4 and 1 game pieces respectively, for a total of 15 game pieces; and where N=1, there are 2, 2, 1 and 1 game pieces respectively, for a minimum total of six game pieces. It is believed that the game is less interesting as N decreases from 3, but may, nevertheless, be satisfying to play.

Figure 4C:
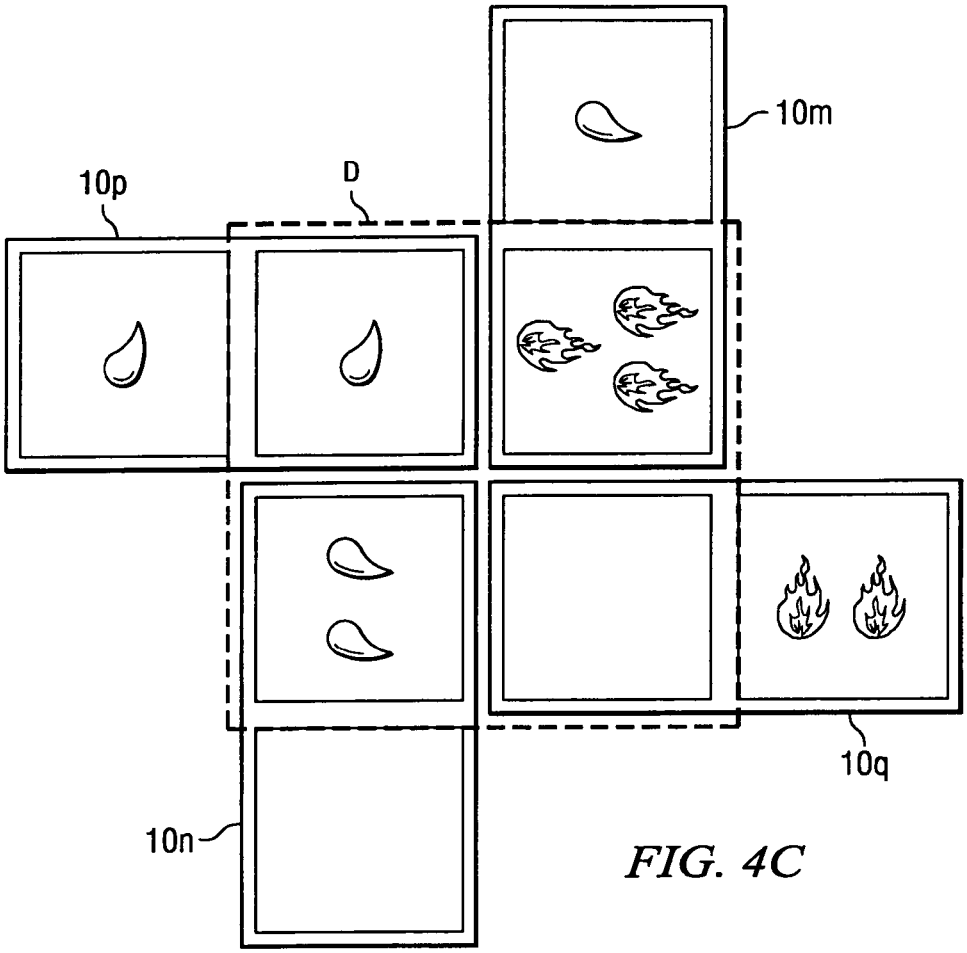
FIG. 4A is a pictorial view of a game piece being laid down in a legal move according to the invention.
FIG. 4B is a pictorial view of the result of the move of FIG. 4A, showing a square that is formed thereby.

The basic rule of the game is that the pieces may be laid down by completing a square that consists of four halves, wherein the sum of the indicia for the four halves is zero. Referring to FIGS. 4A–4C, three illustrative examples of laying down game pieces so as to satisfy this criteria are shown.

FIG. 4A shows the simple case where game piece 10*m* and game piece 10*n* are disposed adjacent to and aligned with one another so that, in the preferred embodiment of the invention, corresponding halves of the game pieces form a square "A." In general, the term "aligned" as used herein to describe a physical relationship between two game pieces means that the game pieces have their long axes in the same direction.

In the example of FIG. 4A, adding or summing the one water indicium and the three fire indicia of the game piece 10*m* with the two water indicia of the game piece 10*n* sums to zero as required.

In FIG. 4B, the game pieces 10*m* and 10*n* were previously laid down to form the square "B", wherein the two water indicia of the game piece 10*p* combined with the one water indicium and the three fire indicia of the game piece 10*m* to form a zero-sum as required. Subsequently, the game piece 10*n* was laid down so as to abut both game pieces 10*m* and 10*p*, forming the square "C," which also meets the requirement for a zero-sum.

In FIG. 4C, the game pieces 10*m*, 10*n*, and 10*p* were previously laid down to form squares (not shown for clarity) meeting the zero-sum requirement. The game piece 10*q* is subsequently laid down to complete the square "D."

While FIGS. 4A, 4B and 4C show, respectively, examples of forming a square from two, three and four game pieces, the game pieces may be oriented differently, relative to each other. For example, in FIG. 4A, either of the game pieces may be rotated 180 degrees. In FIG. 4B, the game piece 10*m* may be rotated 90 degrees clockwise, or the game piece 10*p* may be rotated 90 degrees counterclockwise, and in FIG. 4C, any or all of the game pieces can be rotated 90 degrees clockwise in the example shown. FIGS. 4A and 4B show just one orientation in space, and FIG. 4C shows one "handedness," which may be reversed.

The physical configuration of the game and its general object having been shown and described, below are described more detailed rules of the game according to a preferred embodiment of the invention.

Preferably, there are two to four players, although more players may be accommodated with suitable modification to the rules and to the number of game pieces.

For twenty-eight rectangular game pieces of about 2"×1", a 10"×10" square playing surface is identified or provided. All twenty-eight pieces are placed beside the playing surface, top surface down and mixed up. Where there are two players, each selects and withdraws nine pieces, so that eighteen total pieces are selected and withdrawn and ten pieces remain as a "draw" pile. Where there are three players, each selects and withdraws nine pieces, so that one piece remains. Where there are four players, each selects and withdraws seven pieces and no pieces remain. The number of game pieces distributed to the players may be altered without departing from the principles of the invention.

Where there are two players, one of the pieces from the draw pile is placed on the playing surface, turned so that its top surface 12 faces upwardly. Where there are three players, or where it is otherwise arranged that there is only one piece remaining, the one piece remaining is placed in the same manner. Where there are four players, there is no remaining piece. The number of game pieces remaining, for use as a draw pile or as starter pieces, may be altered without departing from the principles of the invention.

Each player, in turn, has two alternative modes of play. In the first alternative, the player may lay a game piece next to game pieces that have been previously laid down, i.e., against any of the edge surfaces 16 thereof, so long as every square that is formed contains a zero-sum.

Figure 5A:
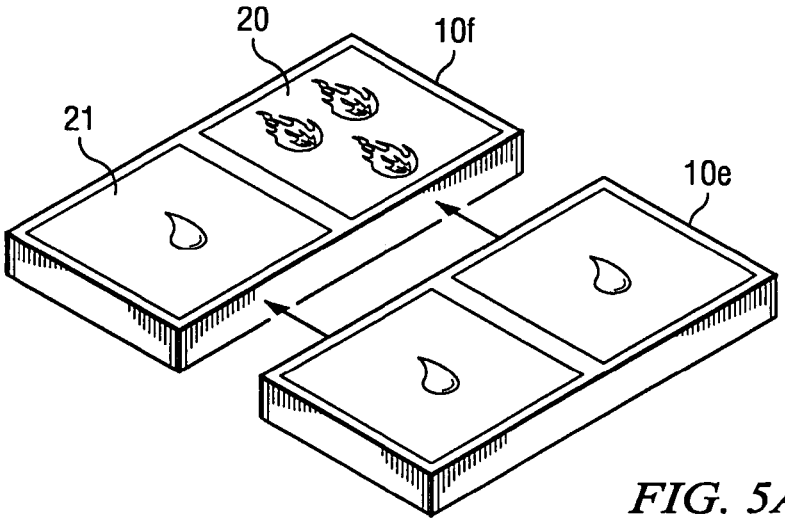
FIG. 5A is a pictorial view of two separate game pieces being laid down in two separate legal moves according to the invention.
Figure 5B:
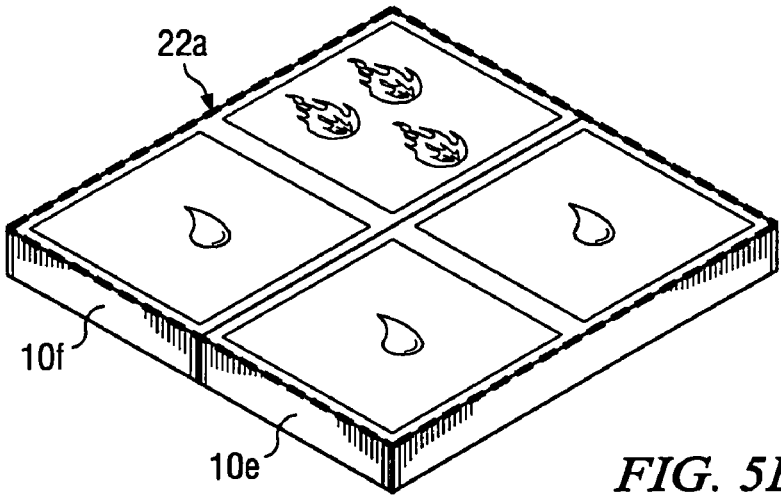
FIG. 5B is a pictorial view of the result of one of the moves of FIG. 5A, showing a square that is formed thereby.

If no game piece was initially laid down, the first player lays down a game piece from his or her hand and play passes to the next player. Otherwise, the first player's objective is to form a first square containing the same number of "fire" and "water" indicia. FIG. 5A shows an example of such a legal move, wherein game piece 10*e* is moved adjacent game piece 10*f* that was laid down from the draw pile, to form a square 22*a* (FIG. 5B). The game piece 10*f* has three "fire" indicia and one "water" indicium, while the game piece 10*e* has two "water" indicia, so that the sum of "fire" indicia in the square 22 is equal to three and the sum of "water" indicia in the square is also equal to three, the two sums canceling out to produce a net zero-sum.

For the next and all subsequent players, the square may be completed by one or both "halves" 20, 21 of the next player's game piece in conjunction, respectively, with either three or two halves 20, 21 of the game pieces already on the playing surface.

Figure 6A:
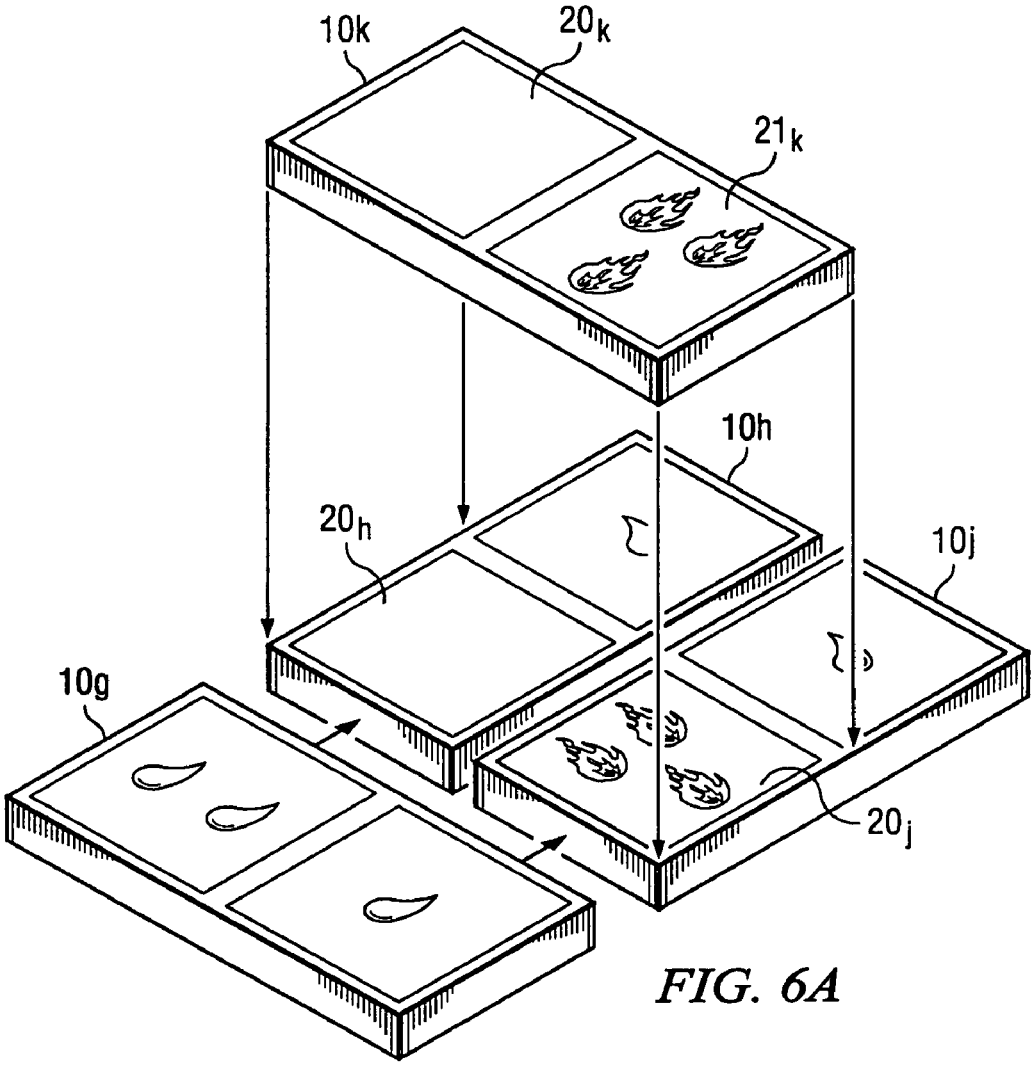
FIG. 6A is a pictorial view of two separate legal moves according to the invention.
Figure 6B:
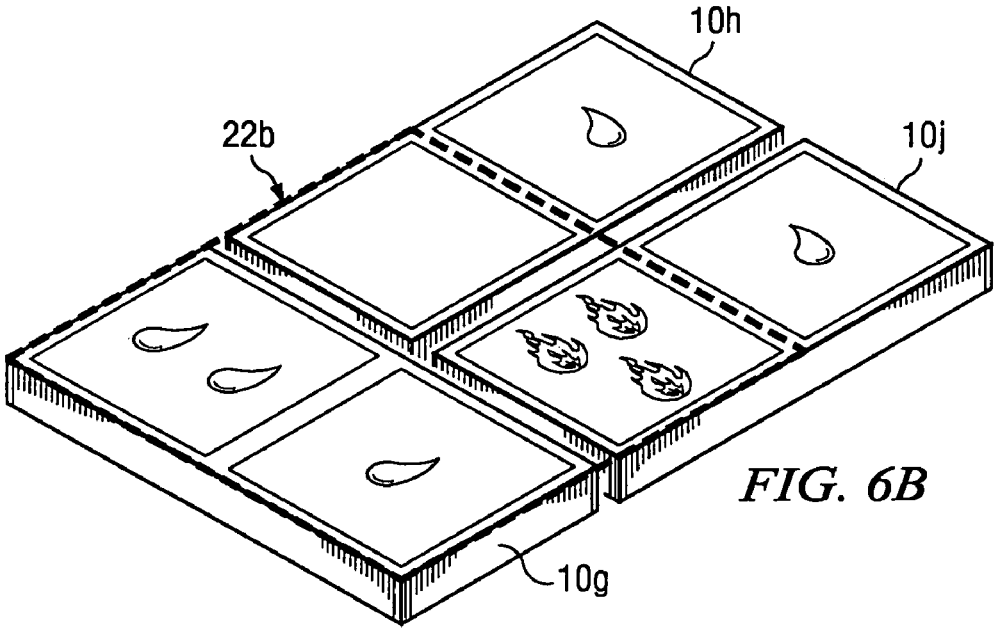
FIG. 6B is a pictorial view of the result of one of the moves of FIG. 6A, showing a square that is formed thereby.

FIG. 6A shows an example of a legal move corresponding to subsequent play under this alternative, wherein game piece 10*g* is moved adjacent to the ends of game pieces 10*h* and 10*j* which have previously been laid down. The square indicated as 22*b* (FIG. 5B) is thereby formed.

In the second alternative, the player may place a game piece on top of two other game pieces that have been previously laid down, so that each of the halves 20, 21 of the game piece now being played precisely overlaps associated halves of the two game pieces underneath and so that the indicia on the halves 20, 21, precisely match the indicia of the associated halves of the two game pieces directly underneath.

FIG. 6A shows an example of this move as well, where game piece 1 Ok is moved on top of game pieces 10*h* and 10*j*, so that the two halves $\mathbf{20}_k$, $\mathbf{21}_k$ of game piece 10*k* lie on top of associated halves $\mathbf{20}_h$ and $\mathbf{20}_j$ of the game pieces 10*h* and 10*j*. The lack of any indicia associated with the half $\mathbf{20}_k$ of the game piece 10*k* matches the lack of any indicia on the half $\mathbf{20}_h$ of the game piece 10*h*, and the three "fire" indicia associated with the half $\mathbf{21}_k$ of game piece 10*k* are matched by the same number of fire indicia associated with the half $\mathbf{20}_j$ of the game piece 10*j*.

The player may continue to stack game pieces on top of existing game pieces so long as the aforementioned requirements are being met. Where there are duplicate game pieces, one game piece may be stacked on one other, duplicate, game piece. As another variation, a game piece may be legally stacked where its indicia matches the total indicia on the respective halves of the game piece or pieces beneath, allowing for potentially interesting "flips" of the stacked game piece.

A player's turn ceases once the player completes a square according to the first alternative, or cannot lay down any more game pieces according to the second alternative. If the player was unable to make a move according to either alternative and there is a draw pile, the player may draw one piece from the draw pile as play proceeds to the next player.

A preferred method for scoring the game is described next. A player "goes out" by being the first player to play all of his/her game pieces. The score for the player who "goes out" is the total number of fire indicia added to the total number of water indicia on all of the game pieces left in the other players' hands, and additionally, in the case of two players, the total number of fire indicia added to the total number of water indicia on all of the game pieces left in the "draw" pile. Rounds of play continue until a player reaches 100 points, whereupon that player is declared the winner of the game.

A player may receive a "20 point bonus award" by laying a game piece on the playing surface, i.e., not on top of other game pieces, which completes two squares simultaneously meeting the requirement for a zero sum. However, it is not a legal move to create two squares simultaneously where one of the squares does not meet the requirement for a zero sum.

When a round terminates wherein no player is able to lay down a game piece, the draw pile is exhausted, and no player has "gone out," each player determines the total number of fire indicia added to the total number of water indicia on all of the game pieces left in his/her hand, and the player with the lowest number wins the round. The player's score for the round is determined by the total number of fire indicia added to the total number of water indicia on all of the game pieces left in the other players' hands, minus the total number of fire indicia added to the total number of water indicia on all of the game pieces left in his or her hand.

While a particular zero-sum tiling game has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

What is claimed is:

1. A zero-sum tiling game, comprising a set of domino-like game pieces having two halves, said set comprising at least six game pieces and indicia associated therewith that may be just one of two types, wherein the indicia for at least one of said game pieces includes both said types, wherein the indicia for at least two of said game pieces includes just one of said types, wherein the indicia for at least two of said game pieces includes just the other of said types, wherein said two types of indicia associated with the game pieces are of opposite polarity, and wherein at least one of said game pieces has no indicia associated therewith.

2. The zero-sum tiling game of claim 1, wherein there are at least twenty-eight of said game pieces, wherein the indicia for at least nine of said game pieces includes both said types, wherein the indicia for at least nine of said game pieces includes just one of said types, wherein the indicia for at least nine of said game pieces includes just the other of said types.

3. A method for constructing a zero-sum tiling game, comprising:

providing for the laying down of a first domino-like game piece having a first integer number of indicia of one of two opposite polarity types, wherein said first number is greater than or equal to zero, and a second integer number of indicia of the other of said polarity types, wherein said second number is greater than or equal to zero; and defining a subsequent move wherein a player subsequently lays down a subsequent domino-like game piece aligned with and adjacent said first game piece, said subsequent game piece having a third integer number of indicia of said one of said two polarity types, wherein said third number is greater than or equal to zero, and a fourth integer number of indicia of said other of said two polarity types, wherein said fourth number is greater than or equal to zero;

wherein it is predefined that said subsequent move is legal when the sum of said first and third numbers equals the sum of said second and fourth numbers, and wherein, otherwise, said move is not legal.

4. A method for constructing a zero-sum tiling game, comprising:

providing for the laying down of a first domino-like game piece having two halves, wherein one of the halves includes a first integer number of indicia of one of two opposite polarity types, wherein said first number is greater than or equal to zero, and a second integer number of indicia of the other of said polarity types, wherein said second number is greater than or equal to zero;

providing for the laying down of a second domino-like game piece having two halves, wherein one of the halves of said second game piece is adjacent said one of the halves of said first game piece, wherein said one of the halves of said second game piece includes a third integer number of indicia of said one of said polarity types, wherein said third number is greater than or equal to zero, and a fourth integer number of indicia of said other of said polarity types, wherein said fourth number is greater than or equal to zero; and defining a subsequent move wherein a player subsequently lays down a subsequent domino-like game piece having two halves, wherein one of the halves of said subsequent game piece is adjacent said one half of said first game piece and the other half of said subsequent game piece is adjacent said one half of said second game piece, said subsequent game piece having a fifth integer number of indicia of said one of said polarity types, wherein said fifth number is greater than or equal to zero, and a sixth integer number of indicia of the other of said polarity types, wherein said sixth number is greater than or equal to zero;

wherein it is predefined that said subsequent move is legal when the sum of said first, third and fifth numbers is equal to the sum of said second, fourth and sixth numbers, and wherein, otherwise, said move is not legal.

5. The method of claim 4, wherein at least one of said first and second numbers is equal to zero, and at least one of said third and fourth numbers is equal to zero.

6. The method of claim 5, wherein said halves are squares and wherein two of said squares are adjacent one another when they form a rectangle.

7. A method for constructing a zero-sum tiling game, comprising:

providing for the laying down of a first domino-like game piece having two halves, wherein one of the halves includes a first integer number of indicia of one of two opposite polarity types, wherein said first number is greater than or equal to zero, and a second integer number of indicia of the other of said polarity types, wherein said second number is greater than or equal to zero;

providing for the laying down of a second domino-like game piece having two halves, wherein one of the halves of said second piece is adjacent said one of the halves of said first game piece, wherein said one of the halves of said second game piece includes a third integer number of indicia of said one of said polarity types, wherein said third integer is greater than or equal to zero, and a fourth integer number of indicia of the other of said polarity types, wherein said fourth, number is greater than or equal to zero;

providing for the laying down of a third domino-like game piece having two halves, wherein one of the halves of said third game piece is adjacent said one of the halves of said second game piece, wherein said one of the halves of said third game piece includes a fifth integer number of indicia of said one of said polarity types, wherein said fifth integer is greater than or equal to zero, and a sixth integer number of indicia of the other of said polarity types, wherein said sixth integer is greater than or equal to zero;

defining a subsequent move wherein a player subsequently lays down a subsequent domino-like game piece having two halves, wherein one of the halves of said subsequent game piece is adjacent said one of the halves of said third game piece, wherein said one of the halves of said subsequent game piece includes a seventh integer number of indicia of said one of said polarity types, wherein said seventh number is greater than or equal to zero, and an eighth integer number of indicia of the other of said polarity types, wherein said eighth number is greater than or equal to zero;

wherein it is predefined that said subsequent move is legal when the sum of said first, third, fifth, and seventh numbers is equal to the sum of said second, fourth, sixth and eighth numbers, and wherein, otherwise, said move is not legal.

8. The method of claim 7, wherein at least one of said first and second numbers is equal to zero, at least one of said third and fourth numbers is equal to zero, at least one of said fifth and sixth numbers is equal to zero, and at least one of said seventh and eighth numbers is equal to zero.

9. The method of claim 8, wherein said halves are squares and wherein two of said squares are adjacent one another when they form a rectangle.

10. A zero-sum tiling game, comprising:

a first plurality of game pieces of substantially identical shape and size, wherein first game indicia are distributed over said first plurality of game pieces so that each game piece has a unique combination of first and second integer numbers of said first game indicia, said first integer number ranging inclusively between zero and a predetermined maximum number of the first game indicia, and said second integer number ranging inclusively between a value of the first integer number and the predetermined maximum number;

a second plurality of game pieces of substantially identical shape and size as said first plurality of game pieces, wherein second game indicia differing from said first game indicia are distributed over said second plurality of game pieces so that each game piece has a unique combination of third and fourth integer numbers of said second game indicia, said third integer number ranging inclusively between zero and said predetermined maximum number of the second indicia, and said fourth integer number ranging inclusively between a value of the third integer number and the predetermined maximum number, except that one combination 0, 0 for the second indicia is omitted;

wherein said first and second indicia are of opposite polarity.

11. The zero-sum tiling game of claim 10, wherein said predetermined maximum number is equal to three, so that there are 10 of said unique combinations, including one combination corresponding to both said first and second integers being equal to zero.

12. The zero-sum tiling game of claim 10, comprising a plurality of third game pieces of substantially identical shape and size as said first and second pluralities of game pieces, said third plurality of game pieces having a unique combination of a fifth integer number of the first indicia ranging between one and the predetermined maximum number, and a sixth integer number of the second indicia ranging between one and the predetermined number.

* * * * *